United States Patent [19]

Bernstein

[11] 4,284,319

[45] Aug. 18, 1981

[54] CRIMP FUSE

[75] Inventor: Elliot Bernstein, Rockville Centre, N.Y.

[73] Assignee: Bel Fuse Inc., Jersey City, N.J.

[21] Appl. No.: 120,278

[22] Filed: Feb. 11, 1980

[51] Int. Cl.[3] ..... H01H 85/16

[52] U.S. Cl. ..... 339/147 P; 337/198; 339/223 R; 339/DIG. 1

[58] Field of Search ..... 337/191, 197, 198, 221, 337/231, 251, 416; 339/147 R, 147 P, 276 T, 223 R, DIG. 1, 159 C, 252

[56] References Cited

U.S. PATENT DOCUMENTS

| | | | |
|---|---|---|---|
| 2,501,996 | 3/1950 | Dillon | 339/197 |
| 3,312,772 | 4/1967 | Sherlock | 339/DIG. 1 |
| 4,218,109 | 8/1980 | Kneusels | 339/223 R X |

FOREIGN PATENT DOCUMENTS

| | | | |
|---|---|---|---|
| 1019531 | 10/1952 | France | 337/198 |

OTHER PUBLICATIONS

"Multiple Wire Termination," E. C. Uberbacher, IBM Technical Disclosure Bull., vol. 9, No. 3, Aug., 1966.

*Primary Examiner*—Eugene F. Desmond

*Attorney, Agent, or Firm*—Ostrolenk, Faber, Gerb & Soffen

[57] ABSTRACT

A fused plug wherein at least one wire of a line cord is connected to a prong member by means of a fuse assembly in which one end of a length of fuse wire or other fuse material is electrically connected as by soldering or crimping to a portion of the line cord wire from which the insulation has been removed, the length of fuse wire lying along the line cord wire and being secured to the insulative sheath thereof by means of a sleeve, which preferably serves to electrically connect the fuse assembly to the prong member. The sleeve may further comprise a tang for connection to the prong member, for instance, by soldering, or the sleeve may be connected to the prong member by ring clip means, or by means of a pigtail to be provided in electrical contact with the sleeve for connection to the prong member. The fuse assembly further comprises an outer insulative sheath that covers the electrical connection between the fuse wire and the line cord wire, and covers a portion of the sleeve. The outer insulative sheath is preferably made of a synthetic material that can be slipped over the line cord wire in the form of a piece of tubing and then shrunk into place by heating.

9 Claims, 8 Drawing Figures

FIG. 1.
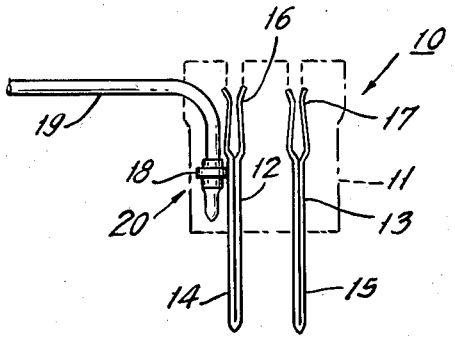
FIG. 2. FIG. 3 FIG. 4 FIG. 5.
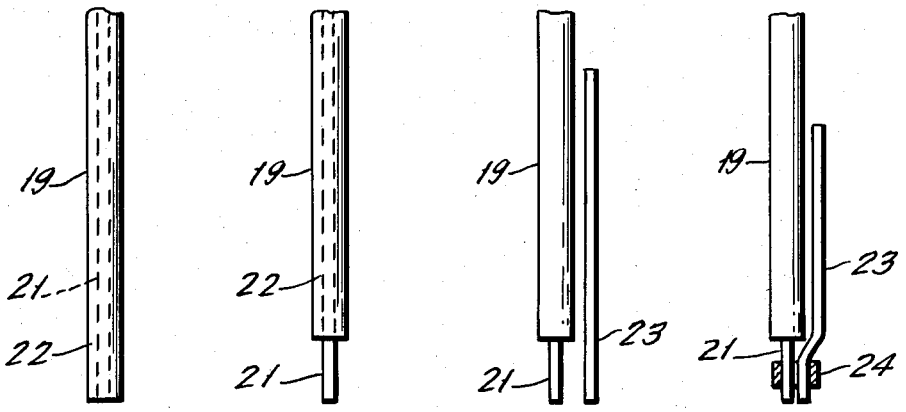
FIG. 7.
FIG. 6.
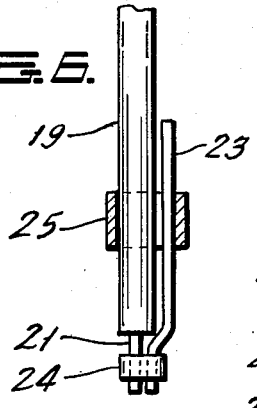
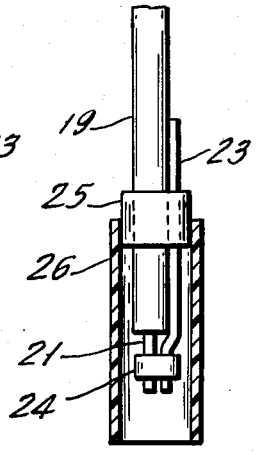
FIG. 8.
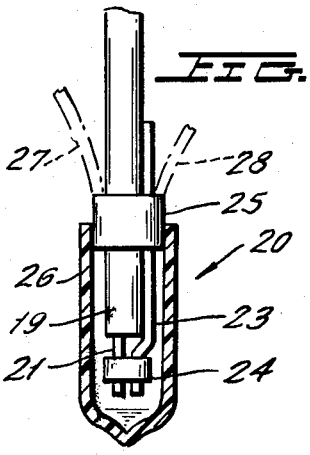

CRIMP FUSE

The present invention relates to fuses and more particularly relates to fuses which are integrated with the plug, which itself is substantially integrated with a line cord of the type extending to household appliances, including small electrical appliances and Christmas light cords.

One of the major problems in the construction of such plugs and cords is to construct a fuse that cannot be tampered with, preferably within the plug, in such a manner that the manufacture of the fuse and its incorporation in the plug will add only a minor cost to that of the manufacture of the entire line cord and plug. Since such line cords and plugs are manufactured competitively at relatively very low prices, the fuse, which must be integrated therewith to meet the requirements of the organizations that establish safety standards, must be extremely simple in design and simple to manufacture and insert, and should add the minimum expense consistent with safety and within the required standards.

The present invention contemplates the formation of a composite line cord and plug in which the insulation is stripped back slightly from the end of at least of one of the wires of the line cord, and one end of a length of fuse wire is crimped or otherwise connected to the exposed end of the wire. The fuse link is oriented so that it lies on the insulation of the line cord wire, and its free end is held in place on the line cord insulation by means of a conductive terminal sleeve. A sheath of insulative tubing is then placed over the fuse link so as to cover the fuse link and all of the exposed portion of the line cord wire, as well as a portion of the conductive terminal sleeve, a portion of which, however, is left uncovered. The insulative tubing is shrunk tightly into place, and the prong member of the plug is soldered or otherwise electrically connected to the exposed portion of the conductive terminal sleeve.

The entire assembly, including the ends of the line cord wires, the crimp fuse assembly and the plug prongs, is then laid into an appropriate mold into which appropriate insulating material is inserted in the proper shape to form the plug, encapsulating the fuse assembly, while the ends of the male prongs of the plug extend therefrom.

In this manner, the primary object of this invention is achieved in forming a simplified inexpensive fuse that can readily be manufactured by existing manufacturing operations and incorporated in the fuse plug and encapsulated therewith simultaneously with the connection of the line cord to the male prongs of the plug.

In a fuse structure in which a fuse link rests against the insulative sheath of a line cord wire, there is a danger that in the event of a low overload that is insufficient to blow the fuse, sufficient heat may nonetheless be generated to melt the line cord wire sheath. The outer insulative tubing of the crimp fuse of the present invention eliminates this danger in a manner to be described hereinbelow.

The foregoing and many other objects of this invention will become apparent in the following description and drawings in which:

FIG. 1 is a view from above of the two male prongs for a plug, one wire of a line cord, and the crimp fuse of the invention, shown in relation to a plug incorporating them (shown in phantom).

FIG. 2 is a view of a line cord wire that is to be provided with the fuse of the invention.

FIG. 3 is a view of the wire after the insulation is stripped away from one end thereof.

FIG. 4 shows the partially stripped wire and a fuse link in position for joining thereto.

FIG. 5 is a view partly in section of the wishbone-shaped connection of the line cord wire and the fuse link, effected by a first sleeve.

FIG. 6 is a view of the assembly of FIG. 5 also showing, in section, a conductive terminal sleeve ring holding the fuse link in place.

FIG. 7 shows the assembly of FIG. 6, with the addition of an outer insulative sheath, shown in section, in the form of a piece of cylindrical tubing.

FIG. 8 is a view of the line cord wire provided with the crimp fuse of the present invention, and showing in phantom an optional pigtail and an optional tang.

Referring to the Figures, a composite line cord and plug assembly 10 incorporating the crimp fuse of the invention comprises a plug body 11 made of a suitable insulative material containing two prong members 12, 13 embedded therein. Each of the prong members 12, 13 has a respective male contact portion 14, 15 projecting from one side of the plug body 11. The prongs may have female contact extensions 16, 17, for an add-on plug if that is desired. Each of the prongs that is to be equipped with the crimp fuse assembly of the present invention may also be provided with a ring clip 18 for electrical connection. A line cord is provided having one wire 19 for connection to one prong 12 and a second wire (not shown) for connection to prong 13. One end of the wire 19 is led into and embedded in plug body 11 and is provided with the crimp fuse 20 of the invention in a manner that will be described in connection with the remaining Figures.

FIG. 2 shows the end of a line cord wire 19 to be provided with the crimp fuse of the invention. Wire 19 includes a conductor 21 enclosed in an insulative sheath 22. First, the insulative sheath 22 is stripped off from a short portion of conductor 21 at the end of wire 19, as shown in FIG. 3. As shown in FIG. 4, a fuse link 23 comprising a length of a suitable fuse material is placed beside and parallel the end of wire 19 in such a manner that the exposed conductor 21 of wire 19 and the end of the fuse link 23 are even. The exposed portion of conductor 21 and the end of the fuse link 23 are then crimped together by means of a first sleeve or crimp ring 24 in a wishbone-shaped junction, as shown in FIG. 5. Fuse link 23 and conductor 21 may be joined instead by soldering, or in any other convenient manner. A second ring or sleeve 25 of conductive material is then placed around wire 19 and fuse link 23 toward the opposite end of the fuse link 23 and crimped in place. This conductive terminal sleeve 25 serves two purposes. First, it holds the fuse link 23 firmly in place along wire 19. Second, it can serve as a terminal for electrical contact to the prong member 12 of the fused plug assembly 10. As shown in FIG. 7, a length of cylindrical tubing 26 made of an insulative material is then placed over the end of wire 19 in such a manner as to cover crimp ring 24, all of wire 19 and fuse link 23 up to the terminal sleeve 25, and a portion of the terminal sleeve 25. Since, as explained above, the latter is used to make contact with prong member 12, it is important that a sufficient portion of terminal sleeve 25 be left uncovered for that purpose.

The material of which the outer insulative sheath 26 is made is preferably one that upon heating will shrink to conform to the shape of the structure it encloses.

The final step of the assembly is to close and seal the open end of insulative sheath 26 as shown in FIG. 8. If the sheath 26 is made of a suitable material, this may be done simply by heating it to cause it to shrink to conform to the shape of the fuse assembly it covers, the open end of the outer sheath 26 closing and sealing itself shut in the process.

Once the fuse connection 20 has been prepared as described in the foregoing, a prong member 12 is clipped by means of a ring clip 18 to the exposed portion of the crimp terminal ring 25. Prong member 12, with the end of wire 19 and fuse connection 20, and prong member 13 with the end of a second wire (not shown) of the line cord are then placed in a suitable mold, which is then filled with a suitable material to form the composite line cord and plug assembly 10 shown in FIG. 1. If desired, an additional crimp ring may be provided inside crimped terminal sleeve 25 for the purpose of securing a pigtail 27. Alternatively, the terminal sleeve 25 may itself be deformed or provided with a tang 28 for connection to a prong member 12, for example by soldering.

The crimp fuse assembly described in the foregoing can be manufactured easily, reliably and economically. In addition, it demonstrates a significant advantage over the prior art, in that with the crimp fuse 20 of the present invention there is no danger that a low overload insufficient to blow the fuse could nevertheless melt the vinyl insulation 22 adjacent the fuse link 23. The reason that the novel fuse 20 of the invention escapes this danger is that the fuse link 23 touches not only the insulative sheath 22 of the wire 19 but also the outer insulative sheath 26. As a result, in the event of a low overload a portion of the heat generated in fuse link 23 would be absorbed by the outer insulative sheath 26 rather than by line cord wire insulation 22, so that a great deal of material would have to be melted before any possible damage could occur.

If desired, an additional sleeve having a higher melting point than that of the fuse link 23 could be placed between the insulation 22 of the line cord wire 19 and the fuse link 23 to provide additional protection against melting of the line cord insulative sheath 22.

In the foregoing, the present invention has been described in connection with illustrative embodiments thereof. Since many variations and modifications of the present invention will now be obvious to those skilled in the art, it is preferred that the scope of this disclosure be determined not by the particular embodiments herein contained but only by the appended claims.

What is claimed is:

1. A fused plug having a main body; a pair of prongs extending from said main body and a line cord having a pair of wires extending into said main body; each of said wires having an insulative sheath;

a fuse connection between at least one of said wires and one of said prongs; said fuse connection comprising a fuse wire, a first sleeve securing one end of said fuse wire to said line cord wire, and a second sleeve of electrically conductive material securing a second portion of said fuse wire remote from said one end of said fuse wire to the insulative sheath of said line cord wire; and an outer insulative sheath covering a portion of said second sleeve and said fuse wire between said one end thereof and said second portion thereof.

2. The fused plug of claim 1, wherein said first sleeve is crimped to said fuse wire and said line cord wire.

3. The fused plug of claim 1, wherein said second sleeve is crimped to said line cord wire and said fuse wire.

4. The fused plug of claim 1, wherein said second sleeve is in electrical contact with said one of said prongs.

5. The fused plug of claim 4, further comprises a tang secured to said second sleeve for connection to said one of said prongs.

6. The fused plug of claim 4, wherein said second sleeve is soldered to said one of said prongs.

7. The fused plug of claim 4, wherein said second sleeve is connected to said one of said prongs by conductive clip means.

8. The fused plug of claim 4, further comprising a pigtail secured to said second sleeve for connection to said one of said prongs.

9. The fused plug of claim 1, wherein said outer insulative sheath is made of a synthetic material that can be shrunk by heating, and wherein said outer insulative sheath is shrunk by heating to fit snugly.

* * * * *